US011823566B2

(12) United States Patent
Lamoncha

(10) Patent No.: US 11,823,566 B2
(45) **Date of Patent: *Nov. 21, 2023**

(54) STOP SIGN WITH TRAFFIC CONTROL FEATURES

(71) Applicant: Mark Lamoncha, Columbiana, OH (US)

(72) Inventor: Mark Lamoncha, Columbiana, OH (US)

( * ) Notice: Subject to any disclaimer, the term of this patent is extended or adjusted under 35 U.S.C. 154(b) by 125 days.

This patent is subject to a terminal disclaimer.

(21) Appl. No.: 17/158,365

(22) Filed: Jan. 26, 2021

(65) Prior Publication Data

US 2021/0150891 A1 May 20, 2021

Related U.S. Application Data

(63) Continuation of application No. 16/682,723, filed on Nov. 13, 2019, now Pat. No. 10,937,309.

(60) Provisional application No. 62/769,034, filed on Nov. 19, 2018.

(51) Int. Cl.

| | |
|---|---|
| ***G08G 1/01*** | (2006.01) |
| ***G08G 1/04*** | (2006.01) |
| ***G08G 1/085*** | (2006.01) |

(52) U.S. Cl.

CPC ..... *G08G 1/0116* (2013.01); *G08G 1/04* (2013.01); *G08G 1/085* (2013.01)

(58) Field of Classification Search

None

See application file for complete search history.

(56) References Cited

U.S. PATENT DOCUMENTS

| | | | | |
|---|---|---|---|---|
| 4,216,989 A * | 8/1980 | Tackett | B60J 11/00 | 296/136.04 |
| 5,673,039 A * | 9/1997 | Pietzsch | G08G 1/015 | 340/905 |
| 6,243,644 B1 * | 6/2001 | Dengler | G08G 1/01 | 340/933 |
| 6,580,374 B2 * | 6/2003 | Schrage | G08G 1/095 | 340/905 |

(Continued)

FOREIGN PATENT DOCUMENTS

| | | | |
|---|---|---|---|
| CA | 3047398 A1 | 6/2018 | |
| FR | 3022673 A1 * | 12/2015 | G08G 1/005 |
| FR | 3040104 A1 * | 2/2017 | |

OTHER PUBLICATIONS

Evelots Flashing LED Auto Parking Signal, Amazon.com, site visited Aug. 21, 2018.

(Continued)

*Primary Examiner* — Fekadeselassie Girma
(74) *Attorney, Agent, or Firm* — STANDLEY LAW GROUP LLP; Jeffrey Standley; Adam Smith

(57) ABSTRACT

Systems and methods related to stop signs with traffic control features are provided. One or more assemblies, each with stop signs and traffic signaling devices which signal vehicles to proceed or wait are provided, preferably at a side of a roadway of an intersection. Arrival times for one or more vehicles are determined. A signal indicating permission to proceed is sent from a command center to the assembly associated with the earliest of the arrival times with permission to set the traffic signaling device of the assembly to proceed.

19 Claims, 5 Drawing Sheets

(56) References Cited

U.S. PATENT DOCUMENTS

| | | | | |
|---|---|---|---|---|
| 6,693,556 | B1 * | 2/2004 | Jones | G08G 1/095 340/815.45 |
| 7,075,427 | B1 * | 7/2006 | Pace | B61L 23/06 246/126 |
| 7,696,903 | B2 * | 4/2010 | Stam | G08G 1/052 340/936 |
| 8,442,750 | B1 * | 5/2013 | Tran | G08G 1/04 340/905 |
| 8,793,062 | B2 * | 7/2014 | Fino | G08G 1/0112 701/1 |
| 9,550,498 | B2 * | 1/2017 | Meyer | G06V 20/56 |
| 10,055,986 | B2 * | 8/2018 | Paruch | G08G 1/081 |
| 10,176,712 | B1 * | 1/2019 | Martins | G08G 1/07 |
| 10,403,142 | B1 * | 9/2019 | Shuff | G08G 1/095 |
| 10,650,672 | B2 | 5/2020 | Shuff | |
| 10,937,309 | B2 * | 3/2021 | Lamoncha | G08G 1/04 |
| 2004/0183694 | A1 * | 9/2004 | Bauer | G08G 1/095 340/933 |
| 2009/0224942 | A1 * | 9/2009 | Goudy | G08G 1/164 340/905 |
| 2010/0283631 | A1 * | 11/2010 | Bryant | G08G 1/07 340/916 |
| 2012/0175859 | A1 * | 7/2012 | Roth, Jr. | B60P 3/125 280/491.4 |
| 2013/0100286 | A1 * | 4/2013 | Lao | G06V 20/54 348/148 |
| 2015/0084369 | A1 * | 3/2015 | Niemi | B62D 35/02 296/180.1 |
| 2016/0005313 | A1 * | 1/2016 | Cholayil | G08G 1/04 340/907 |
| 2017/0046954 | A1 * | 2/2017 | Leversen | E01F 9/00 |
| 2017/0103650 | A1 * | 4/2017 | Amadon | G08G 1/095 |
| 2018/0103240 | A1 * | 4/2018 | Barnes | G01P 13/00 |
| 2019/0035263 | A1 * | 1/2019 | Loes | G08G 1/095 |
| 2019/0206254 | A1 * | 7/2019 | Tao | B60W 50/14 |
| 2019/0279508 | A1 * | 9/2019 | Wang | H04W 4/46 |
| 2020/0005634 | A1 * | 1/2020 | Shuff | G08G 1/095 |
| 2020/0096977 | A1 * | 3/2020 | Itou | G08G 1/081 |
| 2021/0150891 | A1 * | 5/2021 | Lamoncha | G08G 1/04 |
| 2021/0201663 | A1 * | 7/2021 | Lamoncha | G08G 1/04 |
| 2021/0264774 | A1 * | 8/2021 | Lamoncha | G08G 1/085 |
| 2022/0069460 | A1 * | 3/2022 | Bloy | H01Q 21/28 |
| 2022/0379924 | A1 | 12/2022 | Foster et al. | |

OTHER PUBLICATIONS

PerfectStop Sign—Intelligent Stop Sign System, www.indiegogo.com, site visited Aug. 21, 2018.

Safe-T-Signal Warning System, www.ritehite.com, site visited Aug. 21, 2018.

* cited by examiner

STOP SIGN WITH TRAFFIC CONTROL FEATURES

CROSS-REFERENCE TO RELATED APPLICATION

This application is a continuation of U.S. application Ser. No. 16/682,723 filed Nov. 13, 2019, which claims the benefit of U.S. Provisional Application No. 62/769,034 filed Nov. 19, 2018, the disclosures of each of which are hereby incorporated by reference as if fully restated herein.

TECHNICAL FIELD

Exemplary embodiments of the present invention relate generally to a system and method for controlling traffic using a stop sign with traffic control features.

BACKGROUND AND SUMMARY OF THE INVENTION

Traffic congestion is frequently caused by roadway intersections. Traffic often becomes backed up at intersections where conventional stop signs are used to control traffic because drivers are unsure of which driver has the right of way to cross the intersection first. Furthermore, traffic collisions often occur when one driver proceeds despite not having the right of way. While traffic lights can provide for improved traffic flow and reduced accidents, they are too expensive to install at every intersection. Furthermore, stop signs are not adaptable to changing traffic conditions.

Therefore, what is needed is stop sign with traffic control features. The present invention is a stop sign with traffic control features.

An assembly may comprise a conventional stop sign, which may be mounted to a post, pole, or the like. A traffic control unit may comprise one or more signaling devices which direct the driver of a nearby vehicle to proceed or wait. A vehicle detection device may detect vehicles located at or near the assembly. A controller may receive information from the vehicle detection device and direct the traffic control unit. The controller may receive instructions from a central command unit. The central command unit may be in communication with several or all assemblies for a given intersection. A power supply, such as a solar panel, may be electrically connected with various components of the assembly to provide power to the same.

The assembly may continuously scan for the arrival of a vehicle. Once a vehicle is detected, the assembly may note the arrival time and transmit the arrival time to the command center. The command center may determine if an earlier arrival time within a predetermined amount of time has been logged by the same or a different assembly for an intersection. If not, the command center may direct the respective assembly to set its traffic signaling device to proceed. If not, the system may wait until the predetermined time is reached and then direct the respective assembly to set its traffic signaling device to proceed.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
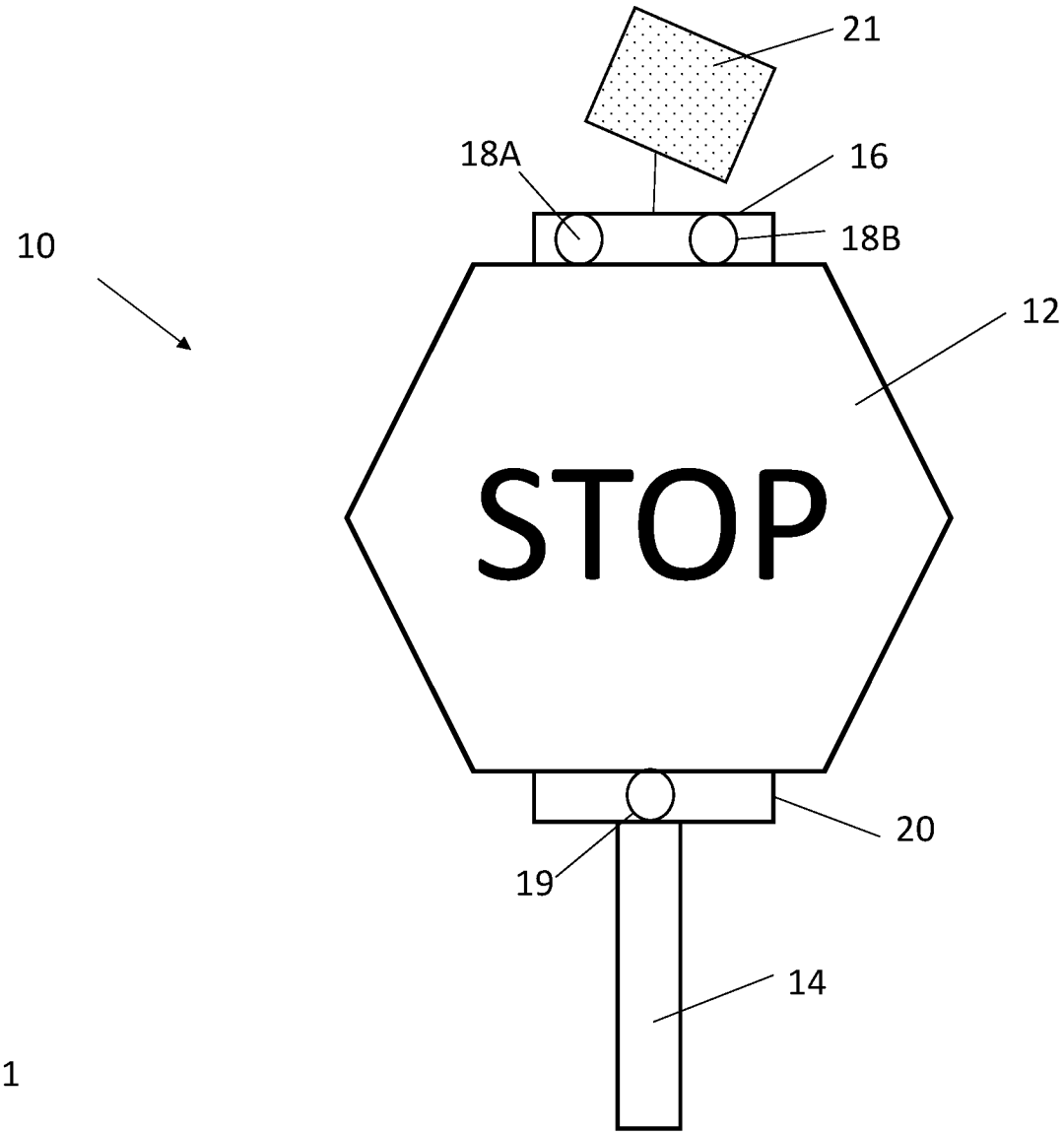
FIG. 1 is front view of an exemplary assembly in accordance with the present invention.

FIG. 1 is front view of an exemplary assembly 10 in accordance with the present invention. The assembly 10 may comprise a conventional stop sign 12. The stop sign 12 may be a static sign, a digital sign, some combination thereof, or the like. The stop sign 12 may be mounted to a mounting device 14. The mounting device 14 may comprise a post, pole, some combination thereof, or the like. The stop sign 12 may be mounted in any fashion, such as but not limited to, an overhead member, a wall, a stand, or the like.

The assembly 10 may comprise a traffic signaling device 16. The traffic signaling device 16 may comprise one or more signaling devices 18A and 18B configured to provide wait and proceed signals. In exemplary embodiments, the signaling devices 18A and 18B comprise one or more colored lights, such as but not limited to red (for wait) and green (for proceed), configured to be selectively illuminated to signal the driver of a vehicle to proceed or to wait. However, any type of signaling devices 18A and 18B is contemplated, such as but not limited to, flags, signs, speakers for producing an audio signal, some combination thereof, or the like. Any number and type of signaling devices 18A and 18B are contemplated. The signaling devices 18A and 18B on various assemblies 10 may be the same or different types. The traffic signaling device 16 may be mounted to the assembly 10, such as above the stop sign 12 though any location is contemplated. In other exemplary embodiments, the traffic signaling device 16 may be located in close proximity with the assembly 10.

The assembly 10 may comprise a vehicle detection device 19. The vehicle detection device 19 may comprise one or more sensors configured to detect the presence of one or more vehicles. The vehicle detection devices 19 may comprise, for example without limitation, cameras, radar, lasers, motion detectors, light sensors, audio sensors, ultrasound sensors, infrared sensors, weight sensors, metal detectors, image recognition software, proximity detectors, some combination thereof, or the like. Alternatively, or in addition, the vehicle detection devices 19 may comprise RFID, Bluetooth®, or other short-range wireless communication devices configured to receive signals from devices installed in vehicles within signaling range of such the vehicle detection devices 19. The vehicle detection device 19 may be mounted to the assembly 10. However, in other exemplary embodiments, the vehicle detection device 19 may instead be located in close proximity with the assembly 10.

The assembly 10 may further comprise a controller 20. The controller 20 may be in communication with one or more of the traffic signaling device 16 and the vehicle detection device 19. The controller 20 may receive data from the vehicle detection device 19 and provide instructions to the traffic signaling device 16. As will be explained in greater detail, in exemplary embodiments the controller 20 is communication with a command center 32. In such embodiments, the controller 20 may communicate information from the vehicle detection device 19 to the command center 32 and receive instructions from the command center 32, which may be relayed to the traffic signaling device 16.

The controller 20 may further comprise a time keeping device 28. The time keeping device 28 may be a clock, timing device, timer, some combination thereof, or the like. The time keeping device 28 may be in electronic communication with the processor 24. It is contemplated that the vehicle detection device 19 may alternatively or additionally comprise the time keeping device 28. Any location of the time keeping device 28 is contemplated.

The assembly 10 may further comprise a power source 21. The power source 21 may be in electrical connection with one or more of the traffic control unit 16, the vehicle detection device 19, and the controller 20. In exemplary embodiments, the power source 21 may comprise a solar panel. Alternatively, or in addition, the power source 21 may comprise one or more batteries. Alternatively, or in addition, the power source 21 may comprise a connector for connecting to utility power.

Figure 2:
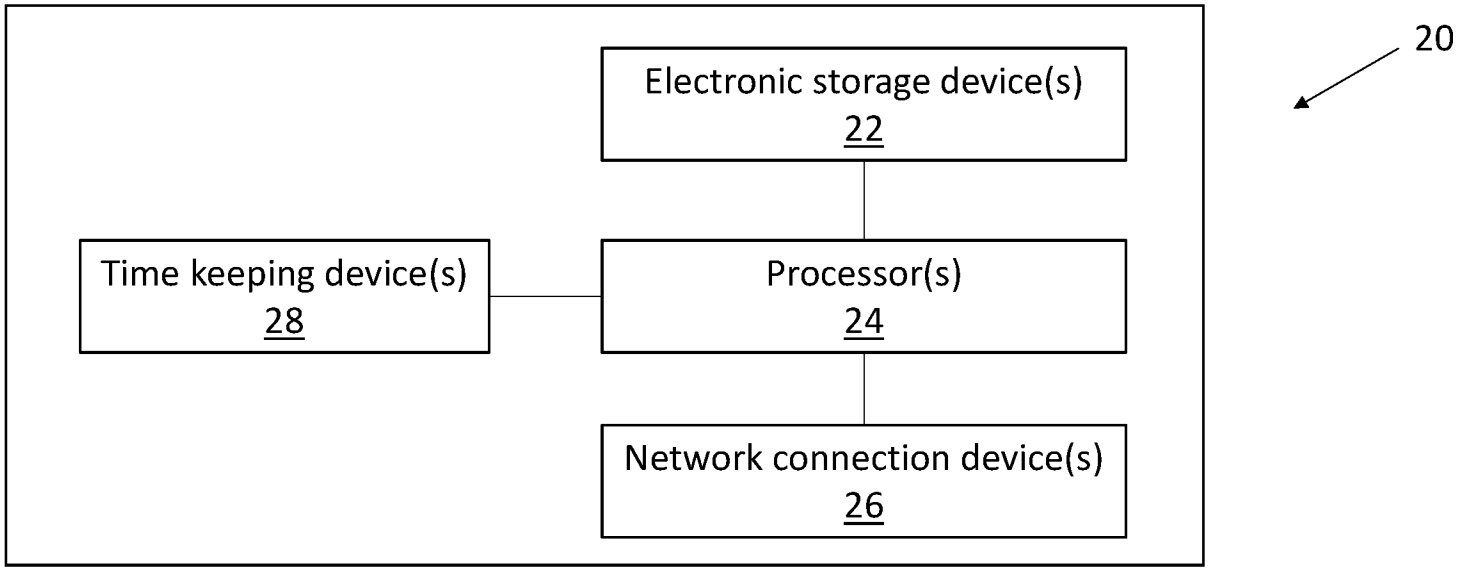
FIG. 2 is a simplified illustration of a controller.

FIG. 2 is a simplified illustration of the controller 20. The controller 20 may be in communication with the vehicle detection device 19 and the traffic signaling device 16. The controller 20, and various components thereof, may be electrically connected to the power supply 21. The controller 20 may comprise one or more electronic storage devices 22, processors 24, and network connection devices 26. The electronic storage device 22 may be configured to receive and store data from the vehicle detection device 19 and/or the controller 20. The electronic storage device 22 may further comprise executable software instructions, which when executed configure the processor 24 to perform one or more of the processes disclosed herein. The processor 24 may be configured to retrieve the data and/or executable software instructions stored at the electronic storage device 22. The network connection device 26 may be configured to transmit and receive data, such as but not limited to data stored at the electronic storage device 22, to the command center 32 and/or to other remote device(s). Such communication may be accomplished by way of a network such as the internet, intranet, cellular network, world wide web, or the like. Such communication may be accomplished by wired or wireless means.

Figure 3:
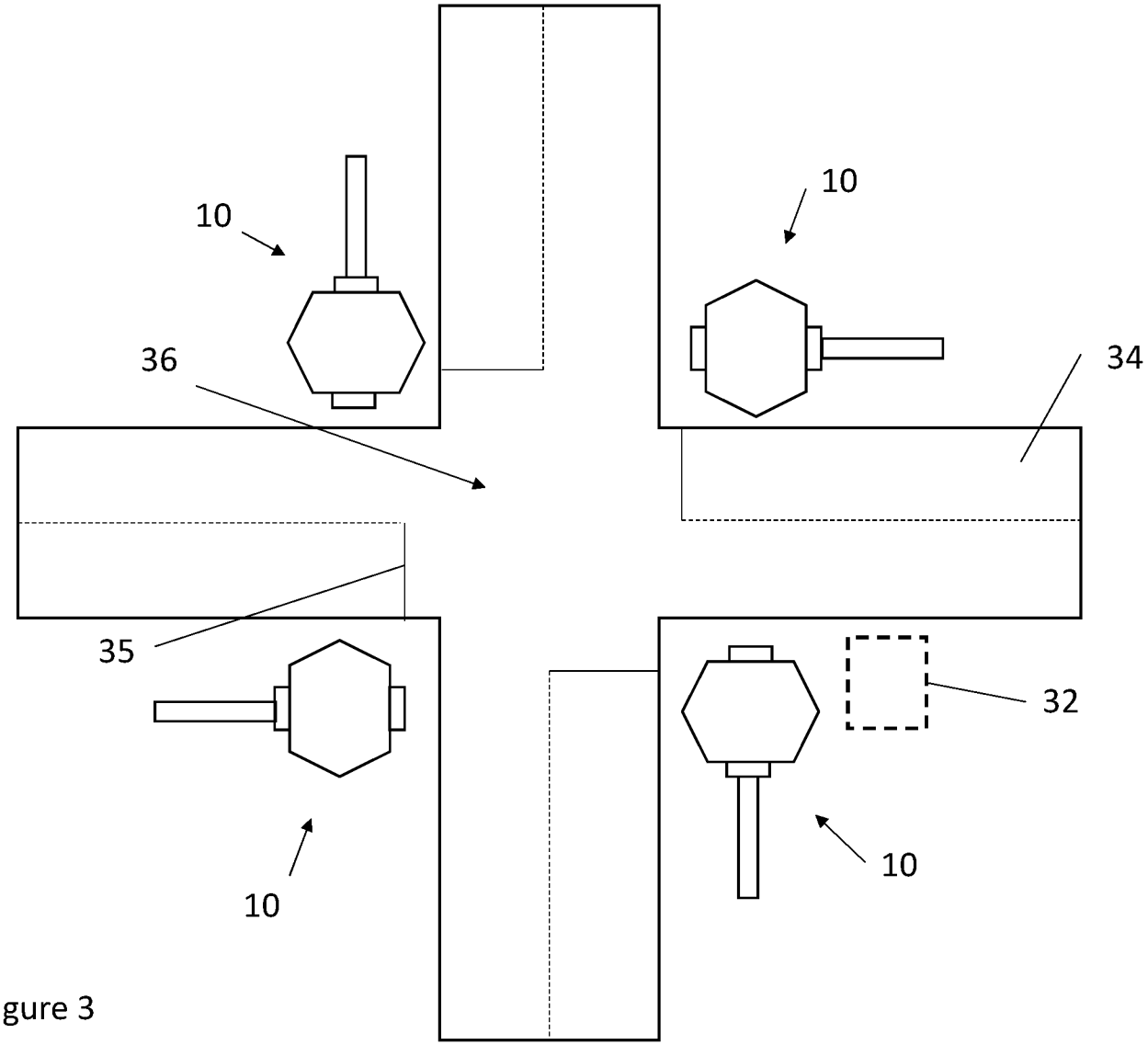
FIG. 3 is a top plan view of an exemplary intersection with multiple assemblies installed.

FIG. 3 is a top plan view of an exemplary intersection 36 with multiple assemblies 10. More specifically, FIG. 3 illustrates a four-way intersection where two roads 34 intersect. Four assemblies 10 may be placed near the intersection 36 such that the flow of traffic is stopped in all four directions. However, any number of assemblies 10 may be utilized with any kind or type of intersection 36 with any number of roads 34. For example, without limitation, two assemblies 10 may be placed at a four way intersection, three assemblies 10 may be placed at a three way intersection, one assembly 10 may be placed at a three way intersection, and the like.

All of the assemblies 10 for a given intersection 36 may be in electronic communication with the command center 32 by way of a wired or wireless connection. In exemplary embodiments, the command center 32 may be buried near the respective intersection 36, though any location is contemplated. It is contemplated that assemblies 10 for more than one intersection 36 may be in communication with a common command center 32.

Figure 4:
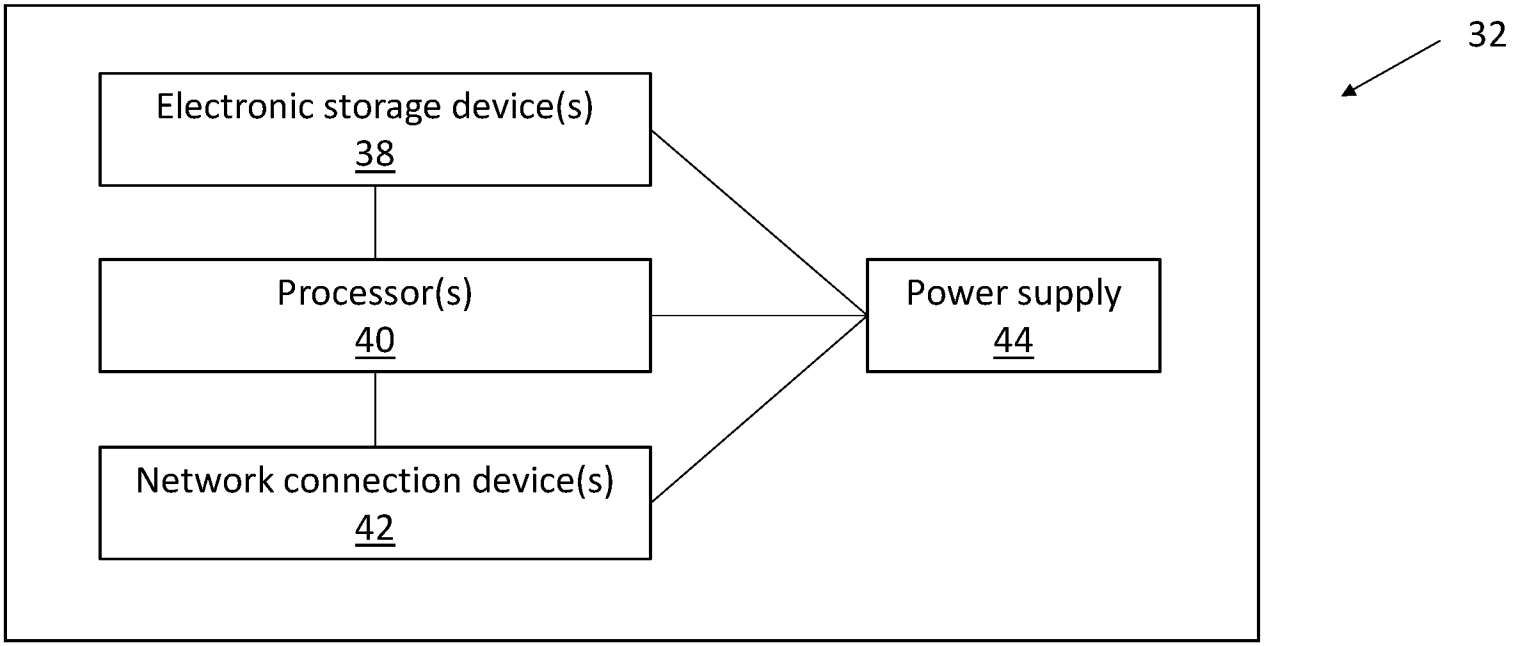
FIG. 4 is a simplified illustration of a command center.

FIG. 4 is a simplified illustration of the command center 32. The command center 32 may be in wired or wireless communication with the controller 20 of each assembly 10 for a particular intersection 36. The command center 32, and various components thereof, may be electrically connected to a power supply 44. The power supply 44 may comprise one or more batteries. Alternatively, or additionally, the power supply 44 may comprise a connector for connecting to a utility line. Alternatively, or in addition, the power supply 44 may comprise a solar panel, wind turbine, some combination thereof, or the like.

The command center 32 may comprise one or more electronic storage devices 38, processors 40, and network connection devices 42. The electronic storage device 38 may be configured to receive and store data from the various assemblies 10. The electronic storage device 38 may further comprise executable software instructions, which when executed configure the processor 40 to perform one or more of the processes disclosed herein. The processor 40 may be configured to retrieve the data and/or executable software instructions stored at the electronic storage device 38. The network connection device 42 may be configured to transmit and receive data, such as but not limited to data stored at the electronic storage device 38, to one or more of the controllers 20 for each assembly 10 and/or other remote device(s). Such communication may be accomplished by way of a network such as the internet, intranet, cellular network, world wide web, or the like. Such communication may be accomplished by wired or wireless means.

Figure 5:
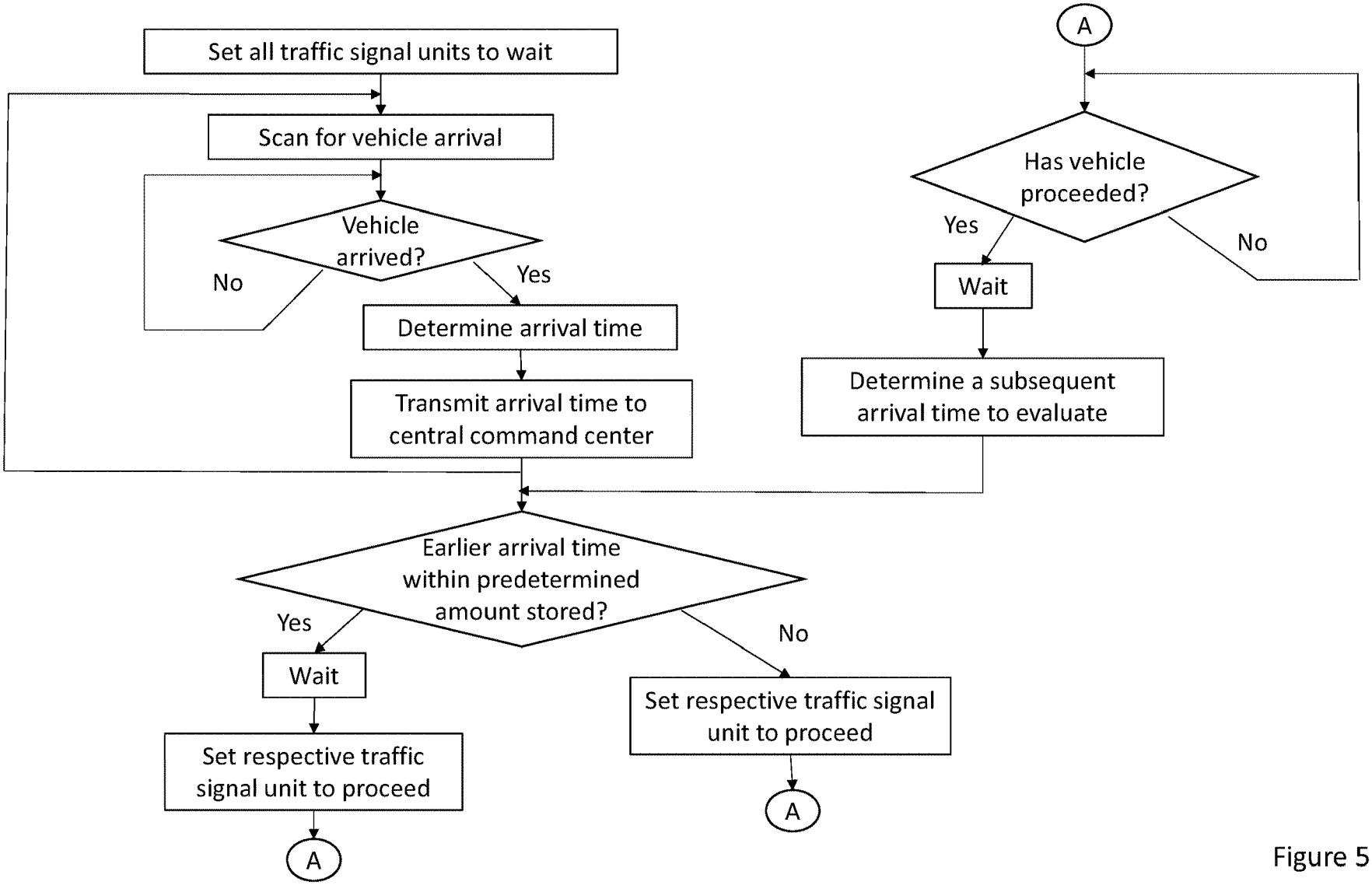
FIG. 5 is a flow chart with exemplary logic for operating the system of FIG. 3 in accordance with the present invention.

FIG. 5 is a flow chart with exemplary logic for operating a system of the assemblies 10 at an intersection 36, such as but not limited to, the intersection 36 shown and described with respect to FIG. 3. Initially, all of the traffic signaling devices 16 for all assemblies 10 for a particular intersection 36 may be set to wait. For example, without limitation, the traffic signaling device 16 may illuminate a red colored light. The vehicle detection devices 19 for all assemblies 10 for the particular intersection 36 may continuously scan for a vehicle's arrival at the intersection 36. In exemplary embodiments, the vehicle detection devices 19 are configured to scan for vehicles located at or near the stop line 35 associated with the respective assembly 10. For example, without limitation, the vehicle detection devices 19 may periodically, continuously, or at any interval take images of the intersection and use machine vision software to determine if a vehicle is within the captured image. As another example, without limitation, the vehicle detection devices 19 may periodically, continuously, or at any interval transmit ultrasonic signals and determine if signals indicating the presence of a nearby vehicle are received.

If no vehicle is detected, the assemblies 10 may continue to scan. Once a vehicle is detected, the respective assembly 10 may determine the vehicle's arrival time at the time keeping device 28. The arrival time may be stored such as at the one or more electronic storage devices 22 of the controller 20. The arrival time may be transmitted to the command center 32. This communication, in exemplary embodiments, is made by way of the network connection device 26 in the respective assembly 10 and the network connection device 42 at the command center 32.

The command center 32 may determine if an earlier arrival time that is within a predetermined amount of time is stored at the electronic storage device 38 for the command center 32. The predetermined amount of time may be any amount of time. In exemplary embodiments, the predetermined amount of time is set such that a vehicle may safely clear the intersection. The predetermined amount of time may be set from historical information.

If no earlier arrival time falling within the predetermined amount of time is found, the command center 32 may direct the respective assembly 10 to set the respective traffic signaling device 16 to proceed. For example, without limitation, the respective traffic signaling device 16 may illuminate a green colored light.

If an earlier arrival time falling within the predetermined amount of time is determined, the command center 32 may direct the respective assembly 10 to wait a sufficient amount of time such that the predetermined amount of time is reached and subsequently instruct the assembly 10 to set the respective traffic signaling device 16 to proceed. Alternatively, the command center 32 may wait until the predetermined amount of time is reached and subsequently direct the respective assembly 10 to set its respective traffic signaling device 16 to proceed.

The vehicle detection device 19 for the assembly 10 which was directed to set its traffic signaling device 16 to proceed may scan to ensure that the vehicle signaled to proceed has actually proceeded. If the vehicle has not proceeded, the vehicle detection device 19 may continue to scan until the vehicle proceeds. In exemplary embodiments, the respective traffic signaling device 16 may take further action such as flashing a green light, emitting an audible tone, some combination thereof, or the like. Once the vehicle has proceeded, a confirmation message regarding the same may be sent to the command center 32. The command center 32 may then evaluate the next earliest vehicle arrival time, thereby repeating the process.

In other exemplary embodiments, once directing the respective traffic signaling device 16 to proceed, the command center 32 may wait a second predetermined amount of time before directing the next respective traffic signaling device 16 to proceed. The second predetermined amount of time may be the same or different as the predetermined amount of time. The second predetermined amount of time may be, for example without limitation, a certain multiple of the predetermined amount of time.

The command center 32 may then repeat the evaluation process for the next subsequently logged entry. In this way, the command center 32 evaluates and processes the arrival times in the order in which they occurred such that earlier arrival times are given priority.

It is notable that while the command center 32 is evaluating the arrival times, the assemblies 10 may be continuously scanning for vehicles, storing, and transmitting the arrival times to the command center 32. In this way, each vehicle's arrival time may be logged and addressed in turn. If no additional vehicles have arrived in the intervening time, the assemblies 10 may simply continue to scan for vehicles.

In exemplary embodiments, the vehicle detection device 19 may be capable of scanning the entire intersection 36 to determine when a vehicle has cleared the intersection. In such embodiments, once the vehicle has cleared the intersection, a confirmation message regarding the same may be sent to the command center 32. The command center 32 may then evaluate the next earliest vehicle arrival time. Each vehicle detection device 19 may comprise multiple sensors of the same or different type which may scan the same or different areas.

In the unlikely event that two identical arrival times are determined, the command center 32 may randomly direct one of the two assemblies 10 to wait the predetermined amount of time and direct the other assembly 10 to set the respective traffic signaling device 16 to proceed.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing device. The electronic devices may be personal computers, smartphone, tablets, databases, servers, or the like. The electronic connections and transmissions described herein may be accomplished by wired or wireless means.

What is claimed is:

1. A traffic control apparatus for an intersection of roadways, the apparatus comprising:

a mounting device installed in a fixed manner at said intersection;

a stop sign connected to the mounting device;

a vehicle detection device installed in a fixed manner at the intersection and configured to detect a vehicle within a range of the vehicle detection device;

a traffic signaling device connected to the mounting device, and configured to visually signal a driver of the vehicle to proceed or wait;

a time keeping device; and a controller configured to:

receive data from the time keeping device indicating an arrival time for the vehicle;

transmit the arrival time to a command center;

receive a signal from the command center indicating permission to proceed; and instruct the traffic signaling device to change from wait to proceed.

2. The apparatus of claim 1 wherein:

the traffic signaling device is external to the vehicle and is configured to be visually altered to signal the driver of the vehicle to proceed or wait; and said controller is configured to instruct the traffic signaling device to change from wait to proceed at least in part by visually altering said traffic signaling device.

3. The apparatus of claim 2 wherein:

the at least one visual signaling device of the traffic signaling device comprises a red light and a green light.

4. The apparatus of claim 1 wherein:

the vehicle detection device comprises a camera; and said controller is further configured to:

receive images from the camera; and determine if the vehicle is depicted within the received images.

5. The apparatus of claim 1 wherein:

the vehicle detection device comprises an ultrasonic sensor; and said controller is further configured to:

transmit ultrasonic signals from the ultrasonic sensor; and monitor for a return of reflected ultrasonic signals.

6. The apparatus of claim 1 wherein:

the mounting device comprises a pole;

the stop sign is mounted to the pole;

the vehicle detection device is mounted to the pole adjacent to the stop sign;

the traffic signaling device is mounted to the pole adjacent to the stop sign; and said command center is remote from said pole.

7. The apparatus of claim 1 further comprising:

a power source electrically connected to the controller, the vehicle detection device, and the traffic signaling device.

8. The apparatus of claim 7 wherein:

the power source comprises a solar panel and a battery.

9. A traffic control system for an intersection of a plurality of roadways, said traffic control system comprising:

a number of assemblies, each installed in a permanent, fixed manner at the intersection in association with one of the plurality of roadways and comprising:

a stop sign;

a vehicle detection device configured to detect a vehicle within a range of the vehicle detection device;

a traffic signaling device comprising one or more lights and configured to visually signal a driver of the vehicle to proceed or wait by altering power supplied to the one or more lights;

a time keeping device; and a controller comprising one or more processors and one or more electronic storage devices comprising executable software instructions, which when executed configure the one or more processors to:

receive data from the time keeping device indicating an arrival time for the vehicle;

transmit the arrival time to a command center;

receive a signal from the command center indicating permission to proceed; and instruct the traffic signaling device to change from wait to proceed by altering power supplied to the one or more lights; and a command center in electronic communication with each of the number of assemblies and configured to:

receive arrival times from the number of assemblies;

determine which of the received arrival times is earliest; and transmit a signal to a respective one of the number of assemblies associated with the earliest of the received arrival times indicating permission to proceed.

10. The system of claim 9 wherein:

the command center is further configured to request confirmation from the respective one of the number of assemblies that the vehicle has proceeded; and the respective one of the number of assemblies is configured to determine that the vehicle has proceeded by way of the vehicle detection device of the respective one of the number of assemblies.

11. The system of claim 9 wherein:

the command center is further configured to:

determine a next earliest one of the received arrival times;

delay a predetermined period of time; and transmit a second signal to a second respective one of the number of assemblies associated with the next earliest one of the received arrival times indicating permission to proceed.

12. The system of claim 11 wherein:

the predetermined amount of time is a multiple of an amount of time corresponding to an expected time it takes for the vehicle to exit the intersection.

13. The system of claim 9 wherein:

each of the assemblies comprise a network communication device;

the command center comprises a network communication device; and said command center is remote from each of the number of assemblies and the vehicle.

14. The traffic control system of claim 9 wherein:

the one or more lights of said traffic signaling device comprises multiple lights, where a first one of which is activated and a second one of which is deactivated to signal proceed, and where the first one of which is deactivated and the second one of which is activated to signal wait.

15. A method for controlling traffic at an intersection of a plurality of roadways, the method comprising the steps of:

setting traffic signaling devices of assemblies installed at the intersection in a fixed location to wait, wherein each of the assemblies comprise a stop sign;

monitoring for arrival of vehicles at the assemblies by way of vehicle detection devices installed at the intersection;

determining an arrival time for each of the arriving vehicles by way of one or more timing devices;

determining, at a command center remote from and in electronic communication with each of the assemblies, which of the arrival times is earliest, wherein said command center is separate and remote from the vehicles; and commanding a respective one of the assemblies from which the earliest of the arrival times is received to set the traffic signaling device for the respective one of the assemblies to proceed.

16. The method of claim 15 further comprising the step of:

sending confirmation from the respective one of the assemblies, as determined by way of at least one of the vehicle detection devices, to the command center that the vehicle associated with the earliest of the arrival times has proceeded.

17. The method of claim 15 further comprising the steps of:

determining, at the command center, the next earliest one of the arrival times;

delaying a predetermined amount of time, wherein the predetermined amount of time greater than an expected amount of time for the vehicle to clear the intersection; and commanding a second respective one of the assemblies from which the second earliest of the arrival times is received to set the traffic signaling device for the second respective one of the assemblies to proceed.

18. The method of claim 16 wherein:

the vehicle detection devices for each of the assemblies comprise a proximity detector configured to detect a presence of one of the vehicles located at a side of the roadway adjacent to the respective assembly;

the traffic signaling device for each of the plurality of assemblies comprises a red colored light and a green colored light; and the arrival times for the arriving vehicles is determined by one or more clocks.

19. A traffic control system for an intersection of a plurality of roadways, said traffic control system comprising:

one or more assemblies, each permanently installed at a fixed location at a side of one of the plurality of roadways and comprising a mounting apparatus, a stop sign, and a traffic signaling device, said traffic signaling device comprising at least one light configured to signal drivers of arriving vehicles to proceed or wait, wherein said stop sign and said traffic signaling device are connected to said mounting apparatus;

one or more vehicle detection devices permanently installed at the intersection at a fixed location and configured to detect the arriving vehicles;

one or more time keeping devices configured to determine arrival times of the arriving vehicles; and a command center remote from and in electronic communication with each of the one or more assemblies, said command center configured to:

determine which of the arrival times is earliest;

if permission to proceed has not been previously transmitted from the command center within a predetermined period of time, transmit a signal to a respective one of the one or more assemblies associated with the earliest of the arrival times indicating permission to proceed; and if permission to proceed has been previously transmitted from the command center within the predetermined period of time, wait a remaining amount of time sufficient to reach or exceed said predetermined amount of time before subsequently transmitting the signal to the respective one of the one or more assemblies associated with the earliest of the received arrival times indicating permission to proceed;

wherein the predetermined amount of time is greater than or equal to an expected amount of time for the vehicle to clear the intersection;

wherein the assemblies are configured to move the at least one light between an illuminated and a non-illuminated state to signal the drivers of the vehicles to proceed or wait in response to receipt of the permission to proceed from the command center.

* * * * *